US005738962A

United States Patent [19]

Ichimura et al.

[11] Patent Number: 5,738,962

[45] Date of Patent: Apr. 14, 1998

[54] TONER FOR FULL-COLOR IMAGE FORMATION, DEVELOPER COMPOSITION, AND METHOD OF FORMING MULTICOLOR IMAGE

[75] Inventors: Masanori Ichimura; Hiroshi Takano; Masaki Hashimoto; Hideyuki Akagi; Kazuya Furuta; Koji Fukushima, all of Ashigara, Japan

[73] Assignee: Fuji Xerox Co., Ltd., Tokyo, Japan

[21] Appl. No.: 730,936

[22] Filed: Oct. 16, 1996

[30] Foreign Application Priority Data

Oct. 20, 1995 [JP] Japan ..... 7-295876

[51] Int. Cl.[6] ..... G03G 13/16

[52] U.S. Cl. ..... 430/45; 430/126

[58] Field of Search ..... 430/106, 109, 430/120, 45, 26

[56] References Cited

U.S. PATENT DOCUMENTS

| | | | |
|---|---|---|---|
| 2,221,776 | 9/1940 | Carlson | 430/261 |
| 2,618,552 | 11/1952 | Wise | 430/121 |
| 2,874,063 | 3/1959 | Greig | 430/106.6 |
| 5,530,532 | 6/1996 | Iino et al. | 430/126 |
| 5,536,608 | 7/1996 | O'Brien et al. | 430/106 |
| 5,578,407 | 11/1996 | Kasuya et al. | 430/42 |

FOREIGN PATENT DOCUMENTS

| | | |
|---|---|---|
| 0 332 428 A | 9/1989 | European Pat. Off. . |
| 0 466 149 A | 1/1992 | European Pat. Off. . |
| 0 504 942 A | 9/1992 | European Pat. Off. . |
| 0 606 100 A | 7/1994 | European Pat. Off. . |
| 0 631 193 A | 12/1994 | European Pat. Off. . |
| 0 677 794 A | 10/1995 | European Pat. Off. . |
| 56-47551 | 11/1981 | Japan . |
| 59-11103 | 3/1984 | Japan . |
| 59-45452 | 3/1984 | Japan . |
| 2-106767 | 4/1990 | Japan . |
| 2-284158 | 11/1990 | Japan . |

*Primary Examiner*—John Goodrow
*Attorney, Agent, or Firm*—Oliff & Berridge, PLC

[57] ABSTRACT

The toner for full-color image formation of the invention comprises a binder resin and a colorant, wherein the toner has a volume-average particle diameter of from 3.0 to 9.0 μm and satisfies relationship (1) between the volume-average particle diameter and a colorant content thereof:

$$11.0/R \leqq C \leqq 21.5/R \quad (1)$$

wherein R is ½ of the volume-average particle diameter of the toner (μm) and C is the colorant content of the toner (wt %).

This toner for full-color image formation is used to conduct development in such a manner that the toner amount transferred to the receiving paper satisfies relationship (2):

$$0.116R \leqq TMA \leqq \leqq 0.0223R \quad (2)$$

wherein R is ½ of the volume-average particle diameter of the toner (μm) and TMA is the weight of the toner (mg/cm$^2$) transferred to the receiving paper in a monochromatic solid part thereof.

9 Claims, No Drawings

TONER FOR FULL-COLOR IMAGE FORMATION, DEVELOPER COMPOSITION, AND METHOD OF FORMING MULTICOLOR IMAGE

FIELD OF THE INVENTION

The present invention relates to a toner and a developer composition both for the full-color electrophotographic development of an electrostatic latent image and to a method for forming a multicolor image.

BACKGROUND OF THE INVENTION

In electrophotography, known prior art processes for converting an electrostatic latent image formed on a photoconductive photoreceptor or the like into a visible image include, for example, the magnetic blush development described in U.S. Pat. No. 2,874,063, the cascade development described in U.S. Pat. No. 2,618,552, and the powder cloud development described in U.S. Pat. No. 2,221,776. The toners generally used for these development processes comprise a mixture of a thermoplastic resin and a colorant. The toner image formed on the photoconductive photoreceptor or the like by the above or other development processes is transferred to a support such as paper and fixed thereto by pressing and/or heating. With the recent increasing desire for higher image quality in copies, various improvements are being made in both copiers and developers.

In particular, a technique frequently used for improving image quality is to employ a toner having a reduced average particle diameter. Use of a toner having a reduced average particle diameter is an effective means for improving image quality. However, as the average particle diameter of a toner is reduced while maintaining the amount of charges which the toner can have per unit surface area, the amount of charges which the toner can have per unit weight (tribo) increases, resulting in difficulties in development and in obtaining a desired density. If the amount of charges which a toner can have per unit weight (tribo) is reduced in order to facilitate development, the amount of charges which the toner can have per particle is reduced significantly and, as a result, the toner is apt to cause blurring and should be used under various limitations.

A technique of heightening the content of a colorant can be used as a means for facilitating development because this technique is effective in reducing the toner amount necessary for obtaining the same density (coloring power), that is, the weight of the toner transferred to receiving paper in a monochromatic solid part thereof (TMA (toner mass area), $mg/cm^2$) can be reduced. However, too high a colorant content leads to deteriorated image quality (graininess), so that the effect of reduction in particle diameter is lost. Moreover, in the case of toner production through kneading and pulverization, there is a problem that the smaller the average particle diameter, the higher the cost.

SUMMARY OF THE INVENTION

The present invention has been achieved in order to eliminate the problems described above.

An object of the present invention is to provide a toner and a developer composition which are free from the problems caused by the reduction in toner particle diameter for obtaining higher image quality, i.e., free from a density decrease caused by the resulting reduced suitability for development, blurring caused by the resulting significantly reduced amount of charges per toner particle, a decrease in the amount of transferred toner caused by an increased colorant content, and a decrease in image quality caused by the reduced transferred-toner amount, and which can attain both high image quality and suitability for development (proper density and nonblurring).

Another object of the present invention is to provide a toner which can be reduced in consumption rate thereof and can eliminate the problem of cost increase caused by particle diameter reduction.

Still another object of the present invention is to provide a method of forming a multicolor image by which a full-color image with excellent image quality can be obtained.

As a result of investigations, the present inventors have found that the above-described problems of conventional techniques are eliminated when a toner satisfies specific relationships among the volume-average particle diameter thereof, the colorant content (C) thereof, and the weight thereof transferred to receiving paper. The present invention has been completed based on this finding.

The toner for full-color image formation of the present invention comprises a binder resin and a colorant, said toner having a volume-average particle diameter of from 3.0 to 9.0 μm and satisfying the following relationship (1) between the volume-average particle diameter and colorant content thereof:

$$11.0/R \leqq C \leqq 21.5/R \quad (1)$$

wherein R is ½ of the volume-average particle diameter of the toner (μm) and C is the colorant content of the toner (wt %).

The toner for full-color image formation of the present invention preferably has a particle size distribution satisfying the following expressions (a) and (b):

$$D16v/D50v \leqq 1.475-0.036\times D50v \quad (a)$$

$$D50p/D85p \leqq 1.45 \quad (b)$$

wherein D16v and D50v (μm) represent a cumulative 16% volume particle diameter and a cumulative 50% volume particle diameter, respectively, of a cumulative volume particle diameter distribution depicted from the larger volume diameter side of the toner, and D50p and D84p (μm) represent a cumulative 50% population particle diameter and a cumulative 84% population particle diameter, respectively, of a cumulative population particle diameter distribution depicted from the larger population particle diameter side of the toner.

The developer composition of the present invention comprises a carrier and a toner for full-color image formation comprising a binder resin and a colorant, said toner having a volume-average particle diameter of from 3.0 to 9.0 μm and satisfying relationship (1) between the volume-average particle diameter and colorant content thereof, and said carrier being a resin-coated carrier.

In the developer composition of the present invention, the toner preferably has a particle size distribution satisfying expressions (a) and (b) above.

A method of forming a multicolor image on receiving paper, according to the present invention, comprises developing an electrostatic latent image with a cyan toner, a yellow toner, and a magenta toner each comprising a binder resin and a colorant, each of said toners having a volume-average particle diameter of from 3.0 to 9.0 μm and satisfying the following relationship (1) between the volume-average particle diameter and colorant content thereof, and the development being conducted in such a manner that the amount of each toner transferred to the receiving paper satisfies the following relationship (2):

$$11.0/R \leqq C \leqq 21.5/R \quad (1)$$

$$0.116R \leqq TMA \leqq 0.223R \quad (2)$$

wherein R is ½ of the volume-average particle diameter of the toner (μm), C is the colorant content of the toner (wt %), and TMA is the weight of the toner (mg/cm$^2$) transferred to the receiving paper in a monochromatic solid part thereof.

Another method of forming a multicolor image on receiving paper, according to the present invention, comprises developing an electrostatic latent image with a cyan toner, a yellow toner, a magenta toner, and a black toner each comprising a binder resin and a colorant, each of said toners having a volume-average particle diameter of from 3.0 to 9.0 μm and satisfying relationship (1) between the volume-average particle diameter and colorant content thereof, and the development being conducted in such a manner that the amount of each toner transferred to the receiving paper satisfies relationship (2).

DETAILED DESCRIPTION OF THE INVENTION

A detailed explanation is given below on modes of carrying out the present invention.

The toner for full-color image formation of the present invention comprises a binder resin and a colorant as main components. Examples of binder resins which can be used in the toner include homopolymers and copolymers of: styrene and styrene derivatives such as chlorostyrene; monoolefins such as ethylene, propylene, butylene, and isobutylene; vinyl esters such as vinyl acetate, vinyl propionate, vinyl benzoate, and vinyl butyrate; esters of aliphatic α-methylene monocarboxylic acids, such as methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Especially representative binder resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene. Examples of the binder resin further include polyesters, polyurethanes, epoxy resins, silicone resins, polyamides, modified rosins, and paraffin waxes. The binder resin(s) may be contained in the toner in an amount of 60 to 98 wt %.

Examples of the colorant include carbon black, aniline blue, chalcoyl blue, chrome yellow, ultramarine blue, Dupont Oil Red, quinoline yellow, methylene blue chloride, copper phthalocyanine, malachite green oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1, and C.I. Pigment Blue 15:3.

Besides the ingredients described above, known ingredients may be further incorporated if desired and necessary. Examples of such optional ingredients include charge control agents such as metal salts of salicylic acid, metal-containing azo compounds, Nigrosine, and quaternary ammonium salts and offset inhibitors such as low-molecular propylene wax and low-molecular polyethylene wax.

The toner for full-color image formation of the present invention can be produced from the above-described ingredients by a known method. In the present invention, however, the toner is preferably produced by a method comprising kneading and pulverization.

The toner for full-color image formation of the present invention should have a volume-average particle diameter of from 3.0 to 9.0 μm, preferably from 5.0 to 8.0 μm and satisfy the following relationship (1) between the volume-average particle diameter and colorant content thereof.

$$11.0/R \leqq C \leqq 21.5/R \quad (1)$$

Namely, the toner of the present invention should have a volume-average particle diameter (2R) of from 3.0 to 9.0 μm. If the volume-average particle diameter (2R) thereof is smaller than 3.0 μm, the amount of charges which the toner can have per particle is reduced, resulting in poor image quality with considerable blurring. On the other hand, if the volume-average particle diameter (2R) thereof is larger than 9.0 μm, the toner gives an image having impaired graininess and a rough surface.

The colorant content (C) of the toner should satisfy the above-described relationship (1) with the particle diameter of the toner. If the colorant content (C) of the toner is below 11.0/R, a sufficient density (coloring power) cannot be obtained. On the other hand, if the colorant content (C) thereof exceeds 21.5/R, the toner shows too high a density (coloring power), resulting in an unacceptable deteriorated image having no gradation.

From the standpoint of obtaining a high-quality image, the toner preferably has a particle size distribution satisfying the following expressions (a) and (b).

$$D16v/D50v \leqq 1.475 - 0.036 \times D50v \quad (a)$$

$$D50p/D85p \leqq 1.45 \quad (b)$$

In the present invention, the particle size distribution of the toner especially preferably satisfies D16v/D50v≦1.25 and D50p/D84p≦1.3.

External additives may be further added to the toner for full-color image formation of the present invention. Examples of usable external additives include fluidity improvers such as silica, titania, and alumina, cleaning aids or transfer aids such as fine polystyrene particles, fine poly(methyl methacrylate) particles, and fine poly (vinylidene fluoride) particles. Especially preferably used of these external additives is hydrophobic silica having a primary particle diameter of from 5 to 30 nm. The external additive(s) may be added to the toner in an amount of 0 to 5 wt %, preferably 0.5 to 3 wt %.

In the method of the present invention for forming a multicolor image on receiving paper, an electrostatic latent image is developed with a cyan toner, a yellow toner, and a magenta toner which each is the above-described toner for full-color image formation or with these toners and a black toner which is also the above-described toner for full-color image formation. This development should be conducted in such a manner that the amount of each toner transferred to the receiving paper satisfies the following relationship (2):

$$0.116R \leqq TMA \leqq 0.223R \quad (2)$$

wherein R is ½ of the volume-average particle diameter of the toner (μm) and TMA is the weight of the toner (mg/cm$^2$) transferred to the receiving paper in a monochromatic solid part thereof.

TMA, which can be controlled by regulating either the colorant content of the developer or development bias, should be within the range shown by relationship (2) in the present invention. If TMA is increased in order to obtain a desired density (coloring power), the amount of the toner used for development is increased. However, TMA values exceeding 0.223R result in an unacceptable blurred image. On the other hand, if TMA is reduced in order to obtain a reduced density (coloring power), the total toner amount transferred to receiving paper is reduced. However, TMA values below 0.116R result in an unacceptable image with considerably impaired image quality (graininess). Consequently, TMA should be within the range shown by relationship (2).

The toners for full-color image formation of the present invention each may be used as a one-component developer or a two-component developer. In the case where each toner is used as a two-component developer, it is mixed with a carrier. Examples of usable carriers include fine powders of ferrites, iron oxides, and nickel, coated carriers obtained by coating these fine powders with a resin, and carries containing dispersed magnetic particles. Of these carriers, resin-coated carriers are desirable from the standpoint of durability. Preferred coated carriers have an average particle diameter of from 20 to 150 μm. Examples of usable coating resins include fluororesins, silicone resins, styrene resins, acrylic resins, and amide resins.

Although the above-described toners for full-color image formation of the present invention can be suitably used according to dry processes, they may be generally used in a process comprising the steps of forming an electrostatic latent image on an electrostatic-latent-image holder such as, e.g., an electrophotographic photoreceptor or electrostatic recording material, developing the electrostatic latent image with developers in a developing apparatus to form a visible toner image, transferring the toner image to another image holder, and then cleaning the electrostatic-latent-image holder to remove the remaining toners.

A conventionally known electrostatic-latent-image holder may be used in the above process. Examples thereof include Se photoreceptors, organic photoreceptors, amorphous silicon photoreceptors, and photoreceptors obtained by overcoating these photoreceptors according to need. For the cleaning step, any conventionally known cleaning means can be used.

The present invention will be explained below in detail by reference to Examples, but the invention should not be construed as being limited to these Examples in any way. Hereinafter, all parts are by weight. Particle diameter and particle diameter distribution were determined with Coulter Counter Type TA2 (manufactured by Coulter Co.).

EXAMPLE 1

| (Toner) | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 97.5 parts |
| Colorant: carbon black | 2.5 parts |

The ingredients shown above were kneaded with a twin-screw kneader, and the resulting mixture was pulverized and classified to obtain toner particles having a volume-average particle diameter of 9 μm. These toner particles had a D16v/D50v of 1.15 and a D50p/D84p of 1.3. To 100 parts of the toner particles obtained were added 0.7 parts of fine silica particles having an average primary particle diameter of 40 nm and surface-treated with hexamethyldisilazane and 0.7 parts of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 1.0 mg/cm$^2$ to produce copies.

EXAMPLE 2

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 86.7 parts |
| Colorant: magenta pigment | 13.3 parts (pigment, 4.0 parts) |

(colorant prepared by mixing a wet cake of C.I. Pigment Red 57:1 with the polyester binder resin in a proportion of 30 parts (solid pigment amount) to 70 parts and treating the mixture with a heated kneader to disperse the pigment)

The ingredients shown above were kneaded with a twin-screw kneader, and the resulting mixture was pulverized and classified to obtain toner particles having a volume-average particle diameter of 9 μm. These toner particles had a D16v/D50v of 1.15 and a D50p/D84p of 1.3. To 100 parts of the toner particles obtained were added 0.7 parts of fine silica particles having an average primary particle diameter of 40 nm and surface-treated with hexamethyldisilazane and 0.7 parts of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter; 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.65 mg/cm$^2$ to produce copies.

EXAMPLE 3

| | |
|---|---|
| Polyester binder resin (terephthalic acid/bisphenol A propylene oxide adduct/cyclohexanediol = 1.0 mol/0.6 mol/0.4 mol) ($M_w$: 10,000, $Ml_n$: 3,000, $T_g$: 65° C.) | 84.3 parts |
| Colorant: cyan pigment (colorant prepared by mixing a wet cake of C.I. Pigment Blue 15:3 with the polyester binder resin in a proportion of 30 parts (solid pigment amount) to 70 parts and treating the mixture with a heated kneader to disperse the pigment) | 15.7 parts (pigment, 4.7 parts) |

The ingredients shown above were kneaded with a twin-screw kneader, and the resulting mixture was pulverized and classified to obtain toner particles having a volume-average particle diameter of 9 μm. These toner particles had a D16v/D50v of 1.15 and a D50p/D84p of 1.3. To 100 parts of the toner particles obtained were added 0.7 parts of fine silica particles having an average primary particle diameter of 40 nm and surface-treated with hexamethyldisilazane and 0.7 parts of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.53 mg/cm$^2$ to produce copies.

EXAMPLE 4

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 89.3 parts |
| Colorant: cyan pigment (colorant prepared by mixing a wet cake of C.I. Pigment Blue 15:3 with the polyester binder resin in a proportion of 30 parts (solid pigment amount) to 70 parts and treating the mixture with a heated kneader to disperse the pigment) | 10.7 parts (pigment, 3.2 parts) |

The ingredients shown above were kneaded with a twin-screw kneader, and the resulting mixture was pulverized and classified to obtain toner particles having a volume-average particle diameter of 7 μm. These toner particles had a D16v/D50v of 1.2 and a D50p/D84p of 1.3. To 100 parts of the toner particles obtained were added 1 part of fine silica particles having an average primary particle diameter of 40 nm and surface-treated with hexamethyldisilazane and 1 part of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.41. mg/cm$^2$ to produce copies.

EXAMPLE 5

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 86.7 parts |
| Colorant: magenta pigment (colorant prepared by mixing a wet cake of C.I. Pigment Red 57:1 with the polyester binder resin in a proportion of 30 parts (solid pigment amount) to 70 parts and treating the mixture with a heated kneader to disperse the pigment) | 13.3 parts (pigment, 4.0 parts) |

The ingredients shown above were kneaded with a twin-screw kneader, and the resulting mixture was pulverized and classified to obtain toner particles having a volume-average particle diameter of 7 μm. These toner particles had a D16v/D50v of 1.2 and a D50p/D84p of 1.3. To 100 parts of the toner particles obtained were added 1 part of fine silica particles having an average primary particle diameter of 40 nm and surface-treated with hexamethyldisilazane and 1 part of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.65 mg/cm$^2$ to produce copies.

EXAMPLE 6

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 80 parts |
| Colorant: yellow pigment (colorant prepared by mixing a wet cake of C.I. Pigment Yellow 17 with the polyester binder resin in a proportion of 30 parts (solid pigment amount) to 70 parts and treating the mixture with a heated kneader to disperse the pigment) | 20 parts (pigment, 6.0 parts) |

The ingredients shown above were kneaded with a twin-screw kneader, and the resulting mixture was pulverized and classified to obtain toner particles having a volume-average particle diameter of 7 μm. These toner particles had a D16v/D50v of 1.2 and a D50p/D84p of 1.3. To 100 parts of the toner particles obtained were added 1 part of fine silica particles having an average primary particle diameter of 40 nm and surface-treated with hexamethyldisilazane and 1 part of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.78 mg/cm$^2$ to produce copies.

EXAMPLE 7

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 85.3 parts |
| Colorant: yellow pigment (colorant prepared by mixing a wet cake of C.I. Pigment Yellow 12 with the polyester binder resin in a proportion of 30 parts (solid pigment amount) to 70 parts and treating the mixture with a heated kneader to disperse the pigment) | 14.7 parts (pigment, 4.4 parts) |

The ingredients shown above were kneaded with a twin-screw kneader, and the resulting mixture was pulverized and classified to obtain toner particles having a volume-average particle diameter of 5 μm. These toner particles had a D16v/D50v of 1.2 and a D50p/D84p of 1.3. To 100 parts of the toner particles obtained were added 1 part of fine silica particles having an average primary particle diameter of 40 nm and surface-treated with hexamethyldisilazane and 1 part of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.55 mg/cm$^2$ to produce copies.

EXAMPLE 8

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 76.7 parts |
| Colorant: cyan pigment (colorant prepared by mixing a wet cake of C.I. Piginent Blue 15:3 with the polyester binder resin in a proportion of 30 parts (solid pigment amount) to 70 parts and treating the mixture with a heated kneader to disperse the pigment) | 23.3 parts (pigment, 7.0 parts) |

The ingredients shown above were kneaded with a twin-screw kneader, and the resulting mixture was pulverized and classified to obtain toner particles having a volume-average particle diameter of 5 μm. These toner particles had a D16v/D50v of 1.25 and a D50p/D84p of 1.3. To 100 parts of the toner particles obtained were added 1.3 parts of fine silica particles having an average primary particle diameter of 40 nm and surface-treated with hexamethyldisilazane and 1.3 parts of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.29 mg/cm$^2$ to produce copies.

EXAMPLE 9

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 71.3 parts |
| Colorant: magenta pigment (colorant prepared by mixing a wet cake of C.I. Pigment Red 81 with the polyester binder resin in a proportion of 30 parts (solid pigment amount) to 70 parts and treating the mixture with a heated kneader to disperse the pigment) | 28.7 parts (pigment, 8.6 parts) |

The ingredients shown above were kneaded with a twin-screw kneader, and the resulting mixture was pulverized and classified to obtain toner particles having a volume-average particle diameter of 5 μm. These toner particles had a D16v/D50v of 1.25 and a D50p/D84p of 1.3. To 100 parts of the toner particles obtained were added 1.3 parts of fine silica particles having an average particle diameter of 40 nm and surface-treated with hexamethyldisilazane and 1.3 parts of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.45 mg/cm$^2$ to produce copies.

EXAMPLE 10

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 60 parts |
| Colorant: magenta pigment (colorant prepared by mixing a wet cake of C.I. Pigment Red 57:1 with the polyester binder resin in a proportion of 30 parts (solid pigment amount) to 70 parts and treating the mixture with a heated kneader to disperse the pigment) | 40 parts (pigment, 12 parts) |

The ingredients shown above were kneaded with a twin-screw kneader, and the resulting mixture was pulverized and classified to obtain toner particles having a volume-average, particle, diameter of 3.5 μm. These toner particles had a D16v/D50v of 1.3 and a D50p/D84p of 1.3. To 100 parts of the toner particles obtained were added 1.5 parts of fine silica particles having an average primary particle diameter of 40 nm and surface-treated with hexamethyldisilazane and 1.5 parts of fine silica particles having an average primary particle diameter of 20 nm and surface-treated with trimethoxydecylsilane. This mixture was treated with a Henschel mixer and then screened with a screen having an opening size of 45 μm.

| (Carrier) | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.33. mg/cm$^2$ to produce copies.

COMPARATIVE EXAMPLE 1

| (Toner) | |
|---|---|
| Polyester binder resin (terephthalic acid/bisphenol A propylene oxide | 96.0 parts |

-continued

| | |
|---|---|
| adduct/cyclohexanediol = 1.0 mol/0.6 mol/0.4 mol) ($M_w$: 10,000, $M_n$: 3,000, $T_g$: 65° C.) | |
| Colorant: carbon black | 4.0 parts |

The ingredients shown above were kneaded with a twin-screw kneader, and the resulting mixture was pulverized and classified to obtain toner particles having a volume-average particle diameter of 10 μm. These toner particles had a D16v/D50v of 1.3 and a D50p/D84p of 1.3. To 100 parts of the toner particles obtained were added 0.5 parts of fine silica particles having an average primary particle diameter of 40 nm and surface-treated with hexamethyldisilazane and 0.5 parts of fine silica particles having an average primary particle diameter of 20 nm and surface-treated with trimethoxydecylsilane. This mixture was treated with a Henschel mixer and then screened with a screen having an opening size of 45 μm.

(Carrier)

| | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 1.0 mg/cm$^2$ to produce copies.

COMPARATIVE EXAMPLE 2

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 81.7 parts |
| Colorant: cyan pigment (colorant prepared by mixing a wet cake of C.I. Pigment Blue 15:3 with the polyester binder resin in a proportion of 30 parts (solid pigment amount) to 70 parts and treating the mixture with a heated kneader to disperse the pigment) | 18.3 parts (pigment, 5.5 parts) |

The ingredients shown above were kneaded with a twin-screw kneader, and the resulting mixture was pulverized and classified to obtain toner particles having a volume-average particle diameter of 9 μm. These toner particles had a D16v/D50v of 1.3 and a D50p/D84p of 1.3. To 100 parts of the toner particles obtained were added 0.5 parts of fine silica particles having an average primary particle diameter of 40 nm and surface-treated with hexamethyldisilazane and 0.5 parts of fine silica particles having an average primary particle diameter of 20 nm and surface-treated with trimethoxydecylsilane. This mixture was treated with a Henschel mixer and then screened with a screen having an opening size of 45 μm.

(Carrier)

| | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.45 mg/cm$^2$ to produce copies.

COMPARATIVE EXAMPLE 3

| | |
|---|---|
| Polyester binder resin (terephthalic acid/bisphenol A propylene oxide adduct/cyclohexanediol = 1.0 mol/0.6 mol/0.4 mol) ($M_w$: 10,000, $M_n$: 3,000, $T_g$: 65° C.) | 91.7 parts |
| Colorant: cyan pigment (colorant prepared by mixing a wet cake of C.I. Pigment Blue 15:3 with the polyester binder resin in a proportion of 30 parts (solid pigment amount) to 70 parts and treating the mixture with a heated kneader to disperse the pigment) | 8.3 parts (pigment, 2.5 parts) |

The ingredients shown above were kneaded with a twin-screw kneader, and the resulting mixture was pulverized and classified to obtain toner particles having a volume-average particle diameter of 7 μm. These toner particles had a D16v/D50v of 1.2 and a D50p/D84p of 1.3. To 100 parts of the toner particles obtained were added 1.0 part of fine silica particles having an average primary particle diameter of 40 nm and surface-treated with hexamethyldisilazane and 1.0 part of fine silica particles having an average primary particle diameter of 20 nm and surface-treated with trimethoxydecylsilane. This mixture was treated with a Henschel mixer and then screened with a screen having an opening size of 45 μm.

(Carrier)

| | |
|---|---|
| Cu—Zn—Fe cores (volume-average particle diameter, 50 μm) | 100 parts |
| Fluorinated acrylic polymer | 0.5 parts |

The ingredients shown above were mixed by means of a kneader and then dried to obtain a carrier having a volume-average particle diameter of about 50 μm.

(Developer Composition)

The toner was mixed with the carrier in a weight ratio of 10/100 to prepare a developer composition.

Subsequently, the developer composition prepared was introduced into a copier (A-Color 635, manufactured by Fuji Xerox Co., Ltd.), and copying was conducted to evaluate the developer composition. In the copying operation, the weight of the toner transferred to the receiving paper in a monochromatic solid part thereof (TMA) was regulated to 0.41 mg/cm$^2$ to produce copies.

COMPARATIVE EXAMPLE 4

A toner, a carrier, and a developer composition were prepared in the same manner as in Example 5. The composition was evaluated in the same manner, except that in producing copies, the weight of the toner transferred to the receiving paper in a monochromatic solid part thereof (TMA) was regulated to 1.0 mg/cm$^2$.

COMPARATIVE EXAMPLE 5

A toner, a carrier, and a developer composition were prepared in the same manner as in Example 9. The composition was evaluated in the same manner, except that in producing copies, the weight of the toner transferred to the receiving paper in a monochromatic solid part thereof (TMA) was regulated to 0.25 mg/cm$^2$.

COMPARATIVE EXAMPLE 6

A toner, a carrier, and a developer composition were prepared in the same manner as in Example 7. The composition was evaluated in the same manner, except that in producing copies, the weight of the toner transferred to the receiving paper in a monochromatic solid part thereof (TMA) was regulated to 0.65 mg/cm$^2$.

COMPARATIVE EXAMPLE 7

A toner, a carrier, and a developer composition were prepared in the same manner as in Example 10. The composition was evaluated in the same manner, except that in producing copies, the weight of the toner transferred to the receiving paper in a monochromatic solid part thereof (TMA) was regulated to 0.5 mg/cm$^2$.

In Table 1 are shown the results of the evaluation of the developer compositions obtained in Examples 1 to 10 and Comparative Examples 1 to 7. The range of acceptable image density levels in the table is from 1.6 to 2.0. Graininess was determined based on comparison with samples of five grades ranging from G1 (good) to G5 (poor); the acceptable graininess levels are from G1 to G3. Blurring was also determined based on comparison with samples of five grades ranging from G1 (good) to G5 (poor); G2 is on an acceptable level in which the image has slight blurring, while G3 to G5 each is on an unacceptable level with considerable blurring.

TABLE 1

| Range in claim | TN particle diameter, D50v (μm) 3–9 | Colorant content (wt %) 11.0/R–21.5/R | TMA (mg/cm$^2$) 0.116R–0.223R | Color | Imagedensity Acceptable level 1.6–2.0 | Graininess ≦3.0 | Blurring ≦2.0 | Comprehensive evaluation |
|---|---|---|---|---|---|---|---|---|
| Ex. 1 | 9 | 2.5 | 1.0 | black | 1.7 | G2.5 | G2.0 | ○ |
| Ex. 2 | 9 | 4.0 | 0.65 | magenta | 1.8 | G3.0 | G1.0 | ○ |
| Ex. 3 | 9 | 4.7 | 0.53 | cyan | 1.9 | G3.0 | G1.0 | ○ |
| Ex. 4 | 7 | 3.2 | 0.41 | cyan | 1.6 | G3.0 | G1.0 | ○ |
| Ex. 5 | 7 | 4.0 | 0.65 | magenta | 1.8 | G2.0 | G1.0 | ○ |
| Ex. 6 | 7 | 6.0 | 0.78 | yellow | 2.0 | G2.0 | G2.0 | ○ |
| Ex. 7 | 5 | 4.4 | 0.55 | yellow | 1.7 | G1.0 | G2.0 | ○ |
| Ex. 8 | 5 | 7.0 | 0.29 | cyan | 1.6 | G3.0 | G1.0 | ○ |
| Ex. 9 | 5 | 8.6 | 0.45 | magenta | 1.7 | G1.0 | G2.0 | ○ |
| Ex. 10 | 3.5 | 12.0 | 0.33 | magenta | 1.9 | G1.0 | G2.0 | ○ |
| Comp. Ex. 1 | 10 | 4.0 | 1.0 | black | 1.9 | G4.0 | G1.0 | x |
| Comp. Ex. 2 | 9 | 5.5 | 0.45 | cyan | 1.7 | G5.0 | G1.0 | x |
| Comp. Ex. 3 | 7 | 2.5 | 0.41 | cyan | 1.4 | G3.0 | G1.0 | x |
| Comp. Ex. 4 | 7 | 4.0 | 1.0 | magenta | 2.0 | G1.5 | G3.0 | x |
| Comp. Ex. 5 | 5 | 8.6 | 0.25 | magenta | 1.6 | G4.0 | G1.0 | x |
| Comp. Ex. 6 | 5 | 4.4 | 0.65 | yellow | 1.7 | G1.0 | G3.0 | x |
| Comp. Ex. 7 | 3.5 | 12.0 | 0.5 | magenta | 2.0 | G1.0 | G4.0 | x |

EXAMPLES 11 TO 13 AND COMPARATIVE EXAMPLES 8 TO 10

Developer compositions of four colors, i.e., yellow, magenta, cyan, and black, were introduced into a copier (A-Color 635, manufactured by Fuji Xerox Co., Ltd.), and copies were produced in the full-color mode to evaluate the developer compositions. The results obtained are shown in Table 2.

TABLE 2

| | Toners used | Image density (1.6–2.0) K* | M* | C* | Y* | R* | G* | B* | Graininess (≦3.0) | Blurring (≦2.0) | Comprehensive evaluation |
|---|---|---|---|---|---|---|---|---|---|---|---|
| Ex. 11 | Black (Ex. 1)<br>cyan (Ex. 3)<br>magenta (Ex. 2)<br>yellow (Ex. 6) | 1.7 | 1.8 | 1.9 | 2.0 | 1.8 | 1.9 | 1.8 | G3 | G2.0 | ○ |
| Ex. 12 | cyan (Ex. 3)<br>magenta (Ex. 2) | 1.8 | 1.8 | 1.9 | 2.0 | 1.8 | 1.9 | 1.8 | G3 | G2.0 | ○ |

TABLE 2-continued

| | Toners used | Image density (1.6–2.0) K* | M* | C* | Y* | R* | G* | B* | Graininess (≦3.0) | Blurring (≦2.0) | Comprehensive evaluation |
|---|---|---|---|---|---|---|---|---|---|---|---|
| Ex. 13 | yellow (Ex. 6) cyan (Ex. 4) magenta (Ex. 5) yellow (Ex. 7) | 1.7 | 1.8 | 1.6 | 1.7 | 1.7 | 1.6 | 1.6 | G3 | G2.0 | ○ |
| Comp. Ex. 8 | cyan (Ex. 3) magenta (Comp. Ex. 4) yellow (Ex. 6) | 1.8 | 2.0 | 1.9 | 2.0 | 2.0 | 1.9 | 1.9 | G3 | G3.0 | x |
| Comp. Ex. 9 | cyan (Comp. Ex. 2) magenta (Ex. 5) yellow (Ex. 7) | 1.7 | 1.8 | 1.7 | 1.7 | 1.7 | 1.7 | 1.7 | G5 | G2.0 | x |
| Comp. Ex. 10 | cyan (Comp. Ex. 3) magenta (Comp. Ex. 5) yellow (Comp. Ex. 6) | 1.5 | 1.6 | 1.4 | 1.7 | 1.6 | 1.4 | 1.4 | G4 | G3.0 | x |

Remarks: K, M, C, Y, R, G and B represents black, magenta, cyan, yellow, red, green and blue, respectively.

The results given in Table 2 show the following. In evaluation in the full-color mode, a full-color image of excellent quality which was satisfactory in comprehensive evaluation (density, graininess, and blurring) could be obtained when the developer combination used was composed of developer compositions each containing the toner prepared in an Example of the present invention. In contrast, the full-color image obtained with developer compositions at least one of which contained the monochromatic toner prepared in a Comparative Example was unacceptable.

In the case where a full-color image was formed on an OHP sheet using developers of the present invention, the image obtained showed satisfactory light transmission.

Due to the constitution described hereinabove, the toner for full-color image formation of the present invention is free from the conventional problems caused by the reduction in toner particle diameter for obtaining higher image quality, i.e., free from a density decrease caused by the resulting reduced suitability for development, blurring caused by the resulting significantly reduced amount of charges per toner particle, a decrease in the amount of transferred toner caused by an increased colorant content, and a decrease in image quality caused by the reduced transferred-toner amount, and can attain both high image quality and suitability for development (proper density and nonblurring). Consequently, according to the method of the present invention for forming a multicolor image using such toners of the invention, a full-color image with excellent image quality can be obtained while attaining a reduction in toner consumption rate.

It should further be apparent to those skilled in the art that various changes in form and detail of the invention as shown and described above may be made. It is intended that such changes be inclined with in the spirit and scope of the claimed appended hereto.

What is claimed is:

1. A method of forming a multicolor image on receiving paper by developing an electrostatic latent image with a cyan toner, a yellow toner, and a magenta toner each comprising a binder resin and a colorant, each of said toners having a volume-average particle diameter of from 3.0 to 9.0 μm and satisfying the following relationship (1) between the volume-average particle diameter and a colorant content thereof, and the development being conducted in such a manner that the amount of each toner transferred to a receiving paper satisfies the following relationship (2):

$$11.0/R \leqq C \leqq 21.5/R \quad (1)$$

$$0.116R \leqq TMA \leqq 0.223R \quad (2)$$

wherein R represents ½ of the volume-average particle diameter of the toner (μm), C represents the colorant content of the toner (wt %), and TMA represents the weight of the toner (mg/cm$^2$) transferred to the receiving paper in a monochromatic solid part thereof.

2. A method of forming a multicolor image as claimed in claim 1, wherein the cyan toner, the yellow toner and the magenta toner each has a particle size distribution satisfying the following expressions (a) and (b):

$$D16v/D50v \leqq 1.475-0.036 \times D50v \quad (a)$$

$$D50p/D85p \leqq 1.45 \quad (b)$$

wherein D16v and D50v (μm) represent a cumulative 16% volume particle diameter and a cumulative 50% volume particle diameter, respectively, of a cumulative volume particle diameter distribution depicted from the larger volume diameter side of the toner, and D50p and D84p (μm) represent a cumulative 50% population particle diameter and a cumulative 84% population particle diameter, respectively, of a cumulative population particle diameter distribution depicted from the larger population particle diameter side of the toner.

3. A method of forming a multicolor image as claimed in claim 2, wherein D16v/D50v≦1.25 and D50p/D84p≦1.3.

4. A method of forming a multicolor image on receiving paper by developing an electrostatic latent image with a cyan toner, a yellow toner, a magenta toner and a black toner each comprising a binder resin and a colorant, each of said toners having a volume-average particle diameter of from 3.0 to 9.0 μm and satisfying the following relationship (1) between the volume-average particle diameter and a colorant content thereof, and the development being conducted in such a manner that the amount of each toner transferred to a receiving paper satisfies the following relationship (2):

$$11.0/R \leqq C \leqq 21.5/R \quad (1)$$

$$0.116R \leqq TMA \leqq 0.223R \quad (2)$$

wherein R represents ½ of the volume-average particle diameter of the toner (μm), C represents the colorant content of the toner (wt %), and TMA represents the weight of the toner (mg/cm$^2$) transferred to the receiving paper in a monochromatic solid part thereof.

5. A method of forming a multicolor image as claimed in claim 4, wherein the cyan toner, the yellow toner, the magenta toner and the black toner each has a particle size distribution satisfying the following expressions (a) and (b):

$$D16v/D50v \leqq 1.475-0.036 \times D50v \quad \text{(a)}$$

$$D50p/D85p \leqq 1.45 \quad \text{(b)}$$

wherein D16v and D50v (μm) represent a cumulative 16% volume particle diameter and a cumulative 50% volume particle diameter, respectively, of a cumulative volume particle diameter distribution depicted from the larger volume diameter side of the toner, and D50p and D84p (μm) represent a cumulative 50% population particle diameter and a cumulative 84% population particle diameter, respectively, of a cumulative population particle diameter distribution depicted from the larger population particle diameter side of the toner.

6. A method of forming a multicolor image as claimed in claim 5, wherein D16v/D50v≦1.25 and D50p/D84p≦1.3.

7. The method of claim 1, wherein each said toner further comprises a carrier coated with a resin.

8. The method of claim 7, wherein said resin for coating said carrier is selected from the group consisting of a fluororesin, a silicone resin, a styrene resin, an acrylic resin and an amide resin.

9. The method of claim 1, wherein said binder resin is a polyester resin.

* * * * *